US006433445B1

(12) United States Patent
Ahladas et al.

(10) Patent No.: US 6,433,445 B1
(45) Date of Patent: Aug. 13, 2002

(54) ACTIVE MATING CONNECTOR

(75) Inventors: Steven Ahladas; Robert Mullady, both of Highland, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/478,595

(22) Filed: Jan. 6, 2000

(51) Int. Cl.[7] ..... H01J 13/00; H01R 29/00
(52) U.S. Cl. ..... 307/117; 439/96.1; 439/489
(58) Field of Search ..... 307/117; 439/76.1, 439/483, 487, 490, 736, 955, 188, 489, 512, 184, 198

(56) References Cited

U.S. PATENT DOCUMENTS

| | | | | | |
|---|---|---|---|---|---|
| 2,573,920 | A | | 11/1951 | McLeod | |
| 4,892,204 | A | * | 1/1990 | Lumbis | 213/1.6 |
| 5,037,313 | A | * | 8/1991 | Linden et al. | 439/76 |
| 5,103,195 | A | | 4/1992 | Dunsmore | |
| 5,186,639 | A | * | 2/1993 | Comerci et al. | 439/188 |
| 5,244,409 | A | * | 9/1993 | Guss, III et al. | 439/490 |
| 5,268,592 | A | | 12/1993 | Bellamy et al. | |
| 5,356,303 | A | * | 10/1994 | Shibata et al. | 439/198 |
| 5,530,302 | A | * | 6/1996 | Hamre et al. | 307/147 |
| 5,534,782 | A | | 7/1996 | Nourse | |
| 5,581,433 | A | | 12/1996 | Jordan | |
| 5,586,271 | A | | 12/1996 | Parrett | |
| 5,638,289 | A | | 6/1997 | Yamada et al. | |
| 5,668,419 | A | * | 9/1997 | Oktay | 307/126 |
| 5,723,915 | A | | 3/1998 | Maher et al. | |
| 5,773,901 | A | * | 6/1998 | Kantner | 307/112 |
| 5,812,356 | A | * | 9/1998 | O'Connor | 439/345 |
| 5,871,368 | A | * | 2/1999 | Erdner et al. | 439/188 |
| 5,875,307 | A | * | 2/1999 | Ma et al. | 395/281 |
| 5,928,021 | A | * | 7/1999 | Koch | 200/51.09 |
| 6,058,444 | A | * | 5/2000 | Johnson | 326/30 |
| 6,095,837 | A | * | 8/2000 | David et al. | 439/188 |
| 6,170,515 | B1 | * | 1/2001 | Peterson et al. | 137/271 |
| 6,201,709 | B1 | * | 3/2001 | Justiniano et al. | 174/225 |
| 6,220,872 | B1 | * | 4/2001 | Chen | 439/76.1 |
| 6,229,420 | B1 | * | 5/2001 | Bauml et al. | 335/205 |
| 6,244,908 | B1 | * | 6/2001 | Hammond et al. | 200/51.03 |
| 6,302,707 | B1 | * | 10/2001 | Kolar et al. | 439/188 |
| 6,305,960 | B1 | * | 10/2001 | Fan | 439/188 |
| 6,312,264 | B1 | * | 11/2001 | Franz et al. | 439/76.1 |

OTHER PUBLICATIONS

Direct Access Storage Device (DASD) Concurrent Maintenance, IBM Technical Disclosure Bulletin, vol. 33, No. 8, Jan. 1991.

Hot–Plug Circuit, IBM Technical Disclosure Bulletin, vol. 34, No. 4A, Sep. 1991.

Hot Plugging Bus Device, IBM Technical Disclosure Bulletin, vol. 37, No. 02B, Feb. 1994.

* cited by examiner

*Primary Examiner*—Kim Huynh
*Assistant Examiner*—Roberto Rios
(74) *Attorney, Agent, or Firm*—Cantor Colburn LLP; Floyd Gonzalez

(57) ABSTRACT

A completely passive and self-contained solid-state circuit interrupter for removing DC power while mating and unmating connectors is integrated into a connector housing. An electronic mechanism is employed to de-energize the power contacts while the mating connectors are more than a predetermined distance apart.

14 Claims, 1 Drawing Sheet

ACTIVE MATING CONNECTOR

FIELD OF THE INVENTION

The present invention relates to interconnection power cables. More particularly, the present invention relates to the passive connection and disconnection of a DC (direct current) power cable.

BACKGROUND OF THE INVENTION

Complex computer systems employ numerous workstations connected to numerous peripheral computer devices. With the improvement in technology, it is common for one or more of these computing devices to require configuration changes and/or upgrades. Such changes are made to the computer device with the DC (direct current) power disconnected. In order to keep as much of the computer system operational, service personnel typically disconnect and connect the power cable of the particular computing device. This cable includes the DC power for the computer device being serviced. DC power is left on so that DC power is applied to the rest of the system. When an electronic device such as a peripheral is connected to an active computer bus, the power drawn immediately upon insertion or removal of DC power may be sufficient to cause transient voltages to appear on the bus resulting in component damage and/or bus data error. This problem is particularly acute in parallel systems sharing a common bus wherein a transient on one peripheral can cause data errors in all machines connected to the bus. Further, exposed pins can short the DC power bringing down the other bus connected devices or, worse, causing loss of data. Additionally, power on the connector with exposed pins is hazardous to personnel during connection/removal of the DC power.

The DC power as well as other computer signals are often supplied to each computer device through a plug and connector. These are commonly used in computer devices and well known to those in the art. These connectors have a plurality of male pins that mate with a corresponding female receptacles pins. Both the male and female ends may be adapted for termination of a wire harness. This arrangement of a connector plug/receptacle on the end of a wire harness is called a "pendant connector." A connector with power applied is called a "hot-plug." It is analogous to the hot insertion and hot removal of computing devices on a powered up host computer bus.

Typically, power removal is accomplished through electromechanical circuit breakers wherein AC (alternating current) power is removed to large portions of equipment. This requires field maintenance personnel to know where these circuit breakers are located and to remember to disconnect the AC power. Even if this is accomplished, the circuit breakers often are used to power large areas including lighting circuits as well as the receptacle outlets powering the computing device of interest.

It is less disruptive to personnel using the computer equipment to disconnect low voltage DC prior to unmating of equipment connectors powering a specific computing device. In this manner the rest of the computer network remains functional during the maintenance or servicing of a particular computer device. However, the disconnection of an energized power cable poses a safety hazard for personnel and, therefore, requires extreme caution. Further, exposed power contacts may contact objects creating shorts to ground or injecting unwanted voltage transients onto the power lines. This creates a risk of loss of data and loss of compute capability.

A number of devices have been disclosed for computer bus isolation to minimize bus transients during the hot removal and hot insertion of circuit boards, peripherals, etc., e.g., such devices are described in U.S. Pat. Nos. 5,586,271 and 5,210,855. These devices are bulky and do not assure power removal and application without operator intervention.

Further, U.S. Pat. No. 2,573,920, entitled Coupled Actuated Magnetic Switch, describes a plug with an internal magnet arranged to remove AC power from a receptacle outlet containing a magnetic switch when the plug is removed therefrom. This arrangement removes high voltage AC power to prevent short circuits and hazards to personnel. It does not address removal of DC power from a pendant connector. Further, no provision is made for electronic circuitry that can be adapted to apply/remove the power in various ways such as buffering to limit inrush current or bus transients.

Other approaches that passively protect circuitry during hot connect/disconnect of connectors have required reconfiguration of the connector pins, additional circuitry external to the connector, and/or additional wires in the connector harness. One approach requires reconfiguration of the connector to have pins of different lengths. This entails creating specialized connectors with different configurations for different connector applications. Another implementation employs a mechanical interlock switch for a rack/tray assembly whereby inrush currents are managed whenever plugging and unplugging the racks/trays. This switching method is not adapted to connectors on pendant cords nor is a proximity switch employed.

SUMMARY OF THE INVENTION

The present invention employs a proximity switch to determine when mating connectors are in close proximity to each other. Proximity switches are "passive" in that they rely on various types of physical phenomena such as magnetism or capacitive discharge rather than actuation by an operator. The present invention thereby provides a passive mechanism that is contained within a connector housing; requires no additional external wiring; and removes electrical power prior to connector unmating and applies power only after connection during connector mating/unmating. An LED (light emitting diode) or other indicator may be incorporated to provide visual indication of voltage condition.

BRIEF DESCRIPTION OF THE DRAWINGS

The FIGURE is an exploded view drawing of an exemplary implementation of the present invention.

DETAILED DESCRIPTION

Figure 1:
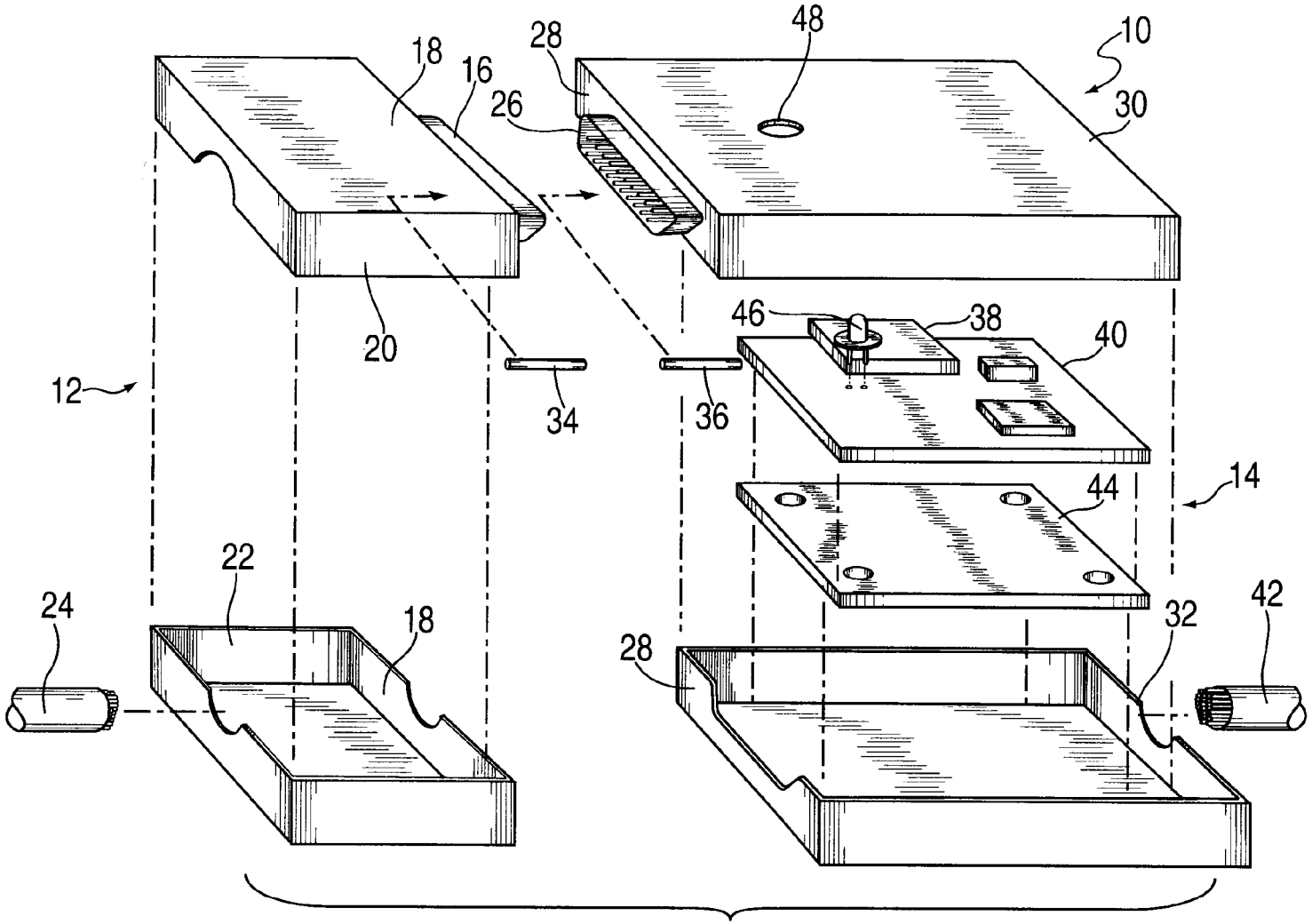

Referring to the FIGURE, an active mating connector arrangement of the present invention is generally shown at 10. Connector arrangement 10 includes mating connector assemblies 12 and 14. Connection assembly 12 has a connector 16 supported in a housing 18 formed by upper and lower housing portions 20, 22. Connector 16 carries a plurality of terminals which have conductors of a cable 24 terminated thereto. Connector 16 may also be a power connector on a device to which a power cable is connected. Connector assembly 14 has a connector 26 supported in a housing 28 formed by upper and lower housing portions 30, 32. Connector 26 also carries a plurality of terminals. Connectors 16 and 26 are mating connectors whereby one of these connectors carries male terminals (pins) while the other connector carries corresponding female terminals (sockets). Connectors 16 and 26 are shown as power D-shell connectors, although other connector types are contemplated by the present invention, such as commonly used for connection of DC power. One of the unused terminal locations of connector 16 has a magnetic member 34 located therein. One of the terminal locations of connector 26 has a member 36 installed therein, this location corresponding to the aforementioned terminal location on connector 16. Members 34 and 36 are part of a proximity switch. Proximity switches are well known and are commercially available. These switches are "passive" in that they rely on various types of physical phenomena such as magnetism or capacitive discharge rather than actuation by an operator.

A power switch (MOSFET) 38 is mounted and electrically connected to a circuit card assembly 40 mounted within housing 28. The power switch 38 is located to receive (communication with) the proximity switch. Conductors of a cable 42 which carry DC power are electrically connected to (terminated at) circuit card assembly 40. Circuit card assembly 40 is secured in housing 28 by any known means (not shown) including being held in place by receiving slots in the housing, secured to standoffs or post with threaded screws or even potted into the housing. A heat sink 44 may be mounted to circuit card assembly 40 in thermal contact to help dissipate heat. Particularly in applications where the circuitry of the circuit card assembly 40 may be required to transfer large amounts of power. Under these circumstances considerable heat may be generated making heat sink 44 necessary.

When connectors 16 and 26 are mated (connected) the proximity switch actuates (i.e., members 34 and 36 sufficiently couple magnetically) causing actuation of the power switch 38. Such magnetic proximity switches have an internal hinged electrical contact (not shown) and stationary electrical contact (not shown). In the presence of a magnetic field the hinged contact is caused to move and make electrical contact with the stationary contact hence actuating the magnetic proximity switch. The proximity switch is set to actuate (thus actuating power switch 38) when the mating connectors are close enough to assure that the mating terminals of connectors 16 and 26 are sufficiently engaged for a reliable power connection. The distance so required is called the "engagement gap". The engagement gap is a function of the particular connector chosen, however, this gap is typically of the order of 0.375 in. (8.63 mm). In response to actuation of the power switch 38, circuitry of the circuit card assembly 40 is arranged to connect the DC power from the cable 42 to the terminals of connector 26 (through the power switch), such being readily apparent to one skilled in the art. DC power is thus enabled to flow from the (input) cable 42 through the circuit card assembly 42 to the terminals of connector plug 26 to terminals of connector 16 and to (output) cable 24. Conversely, the proximity switch is unactuated when connectors 16 and 26 are disengaged (disconnected) a distance equal to or greater than the engagement gap. Then power switch 38 interrupts the power connection.

An indicator (e.g., a light emitting diode (LED)) 46 is electrically mounted on the circuit card assembly 40 and is visible through an opening 48 in housing 28. Circuitry of the circuit card assembly 40 is configured to cause the indicator 46 to illuminate when the DC power is enabled to the terminals of connector 26 thereby providing a technician with a visual indication when the connector is mated (connected) and power is applied. Power for the circuitry of the circuit card assembly 40 is sourced from cable 42, or may be provided by any other suitable means, such as a battery.

The present invention thereby provides a passive mechanism that is contained within a connector housing; requires no additional external wiring, and removes electrical power prior to connector unmating and applies power only after connection during connector mating/unmating. Another advantage of the present invention is the ability for field retrofit. The actuating pin can easily be installed in the field. At that time or a later time the active connector plug/harness assembly can be replaced as one piece without the need to disassemble and reconfigure the connector plug in the field.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A mating connector arrangement for connecting to and disconnecting from a DC powered computer device, comprising:

a first connector carrying a plurality of first terminals, said first connector enclosed in a first housing;

a second connector carrying a plurality of second terminals, said second connector enclosed in a second housing, said second connector for mating with said first connector where said second terminals mate with corresponding said first terminals;

a circuit card assembly, said circuit card assembly mounted within said second housing, said circuit card assembly being electrically connected to a DC power source;

a proximity switch associated with said first and second terminals, said proximity switch actuating when said first and second terminals arc proximate and un-actuating when said first and second terminals are sufficiently apart; and a power switch associated with said second connector and said circuit card assembly and in communication with said proximity switch, wherein said power switch is an electronic circuit power switch, further wherein said power switch provides a connection between said DC power source and at least one of said second terminals through said circuit card when said proximity switch is actuated and disconnecting said DC power source from at least one of said second terminals when said proximity switch is un-actuated.

2. The mating connector arrangement of claim 1 wherein said proximity switch comprises a magnetic proximity switch.

3. The mating connector arrangement of claim 2 further wherein said first and second terminals each includes at least one magnetic member.

4. The mating connector arrangement of claim 1 wherein said proximity switch includes a magnetic member associated with one of said first and second connectors.

5. The mating connector arrangement of claim 1 wherein one of said first and second terminals are male terminals and the other of said first and second terminals are female terminals.

6. The mating connector arrangement of claim 1 further comprising:

an indicator associated with said second connector to indicate when said power switch is providing said connection between said conductor and said at least one of said second terminals.

7. The mating connector arrangement of claim 6 wherein said indicator comprises a light emitting diode.

8. The mating connector arrangement of claim 1 further comprising;

a heat sink in thermal contact with said power switch.

9. The mating connector arrangement of claim 1 wherein said power switch comprises a MOSFET.

10. A method for connecting to and disconnecting from a DC powered computer device, comprising:

mating and un-mating a first connector to a second connector, said first connector carrying; a plurality of first terminals and said second connector carrying a plurality of second terminals, and said first connector mating with said second connector where said first terminals mate with corresponding said second terminals;

actuating a proximity switch in response to the mating of said first and second connectors and un-actuating said proximity switch in response to the un-mating of said first and second connectors; and, actuating and un-actuating a power switch in response to said actuating and un-actuating of said proximity switch, said power switch being an electronic circuit power switch, and said power switch providing a connection between a DC power source and at least one of said second terminals through a circuit card when said proximity switch is actuated and disconnecting said DC power source from said at least one of said second terminals when said proximity switch is un-actuated.

11. The method of claim 10 wherein said proximity switch comprises a magnetic proximity switch.

12. The method of claim 10 further wherein said first and second terminals each includes at least one magnetic member.

13. The method of claim 10 wherein said power switch comprises a MOSFET.

14. The method of claim 10 wherein one of said first and second terminals are male terminals and the other of said first and second terminals are female terminals.

* * * * *